US011445843B2

(12) United States Patent
Leon

(10) Patent No.: US 11,445,843 B2
(45) Date of Patent: Sep. 20, 2022

(54) SHOEHORN TO FACILITATE A HUMAN TO WEAR A SHOE

(71) Applicant: Pedro Luis Leon, Miami, FL (US)

(72) Inventor: Pedro Luis Leon, Miami, FL (US)

( * ) Notice: Subject to any disclaimer, the term of this patent is extended or adjusted under 35 U.S.C. 154(b) by 0 days.

(21) Appl. No.: 15/930,184

(22) Filed: May 12, 2020

(65) Prior Publication Data

US 2021/0353084 A1 Nov. 18, 2021

(51) Int. Cl.
*A47G 25/82* (2006.01)

(52) U.S. Cl.
CPC ..... *A47G 25/82* (2013.01)

(58) Field of Classification Search
CPC ..... A47G 25/82; A47G 25/80; A47G 25/84; A47G 25/845; A47G 25/86; A47G 25/90; A47G 25/905; A47G 25/907; A47G 25/908
USPC ..... 223/111, 112, 113, 114, 115, 116, 117, 223/118, 119
See application file for complete search history.

(56) References Cited

U.S. PATENT DOCUMENTS 5,927,573 A * 7/1999 Votino ..... A47G 25/905 223/111
6,868,997 B1 3/2005 Maguire

FOREIGN PATENT DOCUMENTS

CH 563145 A5 * 6/1975 ..... A47G 25/80
CH 602076 A5 * 7/1978 ..... A47G 25/82

* cited by examiner

*Primary Examiner* — F Griffin Hall

(57) ABSTRACT

An improved mechanical shoehorn that provides a new and unique enhanced application. The shoehorn includes a pivotable handle with a substantial length which helps to push the heel into the shoe. Additionally, the shoehorn includes an arched frontal assembly that widens the shoe opening which makes it easier for a user to slide their foot into the shoe. In one embodiment, the shoehorn further comprises a sock applicator that attaches to the back of the main device.

7 Claims, 15 Drawing Sheets

FIG 1A
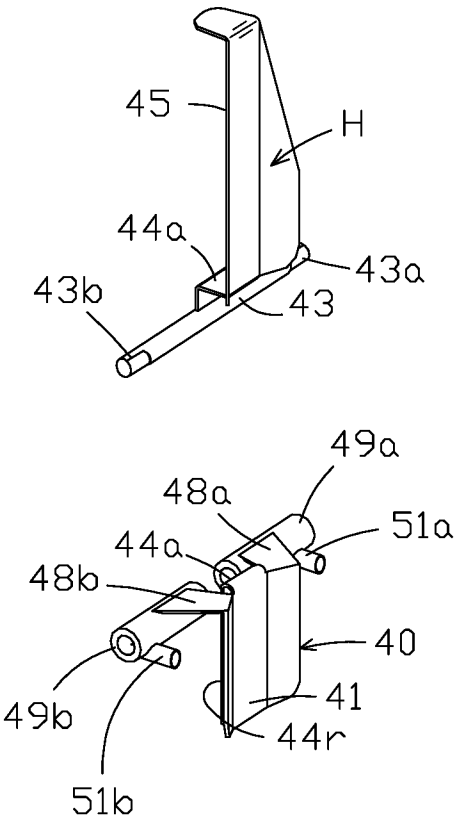
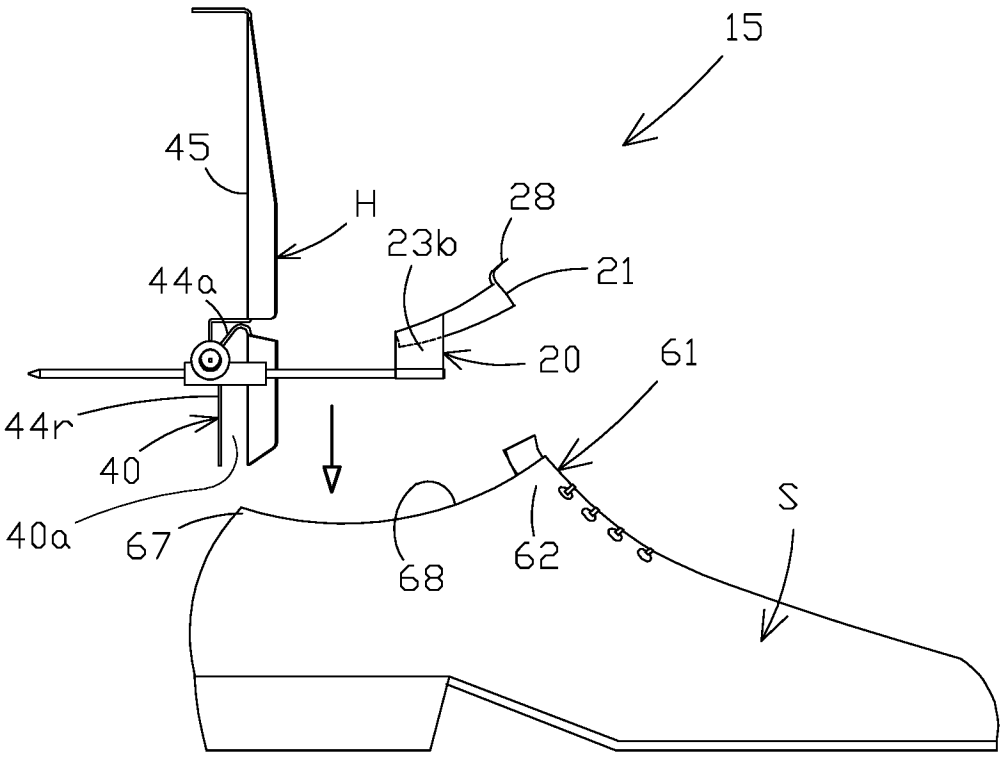
FIG 1

SHOEHORN TO FACILITATE A HUMAN TO WEAR A SHOE

CROSS-REFERENCE TO RELATIVES APPLICATIONS

N/A

BACKGROUND—PRIOR ART

U.S. Pat. No. 6,868,997 to Maguirre, Date: Mar. 22, 2015
Publication no.: US2011/0226821 A1, Date: Sep. 22, 2011

FIELD OF THE INVENTION

The present invention relates to improvements in shoehorns, and more particularly to a mechanical shoehorn aid for wearing shoes.

DESCRIPTION OF THE RELATIVE ARTS

It is known that shoes were created to protect a human's feet.

Shoes have a front section and a rear section designed to accommodate and protect the toe, bridge, ball, and heel of a foot.

A shoe front section includes a throat, a tongue, a right facing, a left facing, a right lacing section, and a left lacing section.

The rear section of the shoe includes a top line or cuff, a right quarter lining, and a left quarter lining.

It is also known that a significant number of people including the obese, elderly, and the physically challenged have difficulty wearing their socks and shoes. Deficits, such as compromised dexterity, flexibility, coordination, extreme low back pain and upper extremity paresis can complicate the task of putting on a shoe.

The difficulties encountered when wearing the shoe is not only in the heel foot section, but also in the bridge section of the foot. None of the prior art or shoehorns have found a solution to this inconvenience.

None of the prior art of shoehorns have also addressed providing a complementary device to help a user wear their socks.

SUMMARY OF THE INVENTION

The present invention comprises of an adjustable shoe size device for use in positioning a person's foot in a shoe to be worn. The device includes a shoehorn having a pivotable/locking handle, a cuff/topline coupling, a slidable arched section for pushing the front shoe section in a forward direction and simultaneously pushing the cuff in a rearward direction while maintaining separate facings by providing substantial pressure, to increase the foot access.

The present invention features an alternate embodiment for users having a critical physical condition to complete the task of wearing a shoe with minimum effort. The alternate embodiment includes a retractable handle for management of a pivotable/locking handle to increase the pressure over the heel while the heel is in the cuff lid and the handle pivots in the frontward direction. Additionally, the embodiment includes a flat floor platform with a. front shoe inverted shape at the front upper section to accommodate the front shoe section. Furthermore, the embodiment includes a plurality of threaded holes centralized by the rear section which aligns with a threaded flat portion joining a pair of threaded vertically fixed barrels. The barrels each have a cavity at each end to receive a pair of threaded rods which include adjustable level nuts to allow a user to adjust the height along the rod. The threaded rods are fixed in the bottom section of a handle pivotable housing and are of small thread fit size for the purpose of quickly inserting or releasing the rods from the barrel cavities and also provide a firm engagement while the foot wearing task is in progress.

The device of the present invention is effective for individuals capable of bending over while seating and more importantly may be used by individuals not capable of bending over due to conditions such as low back pain, obesity, ect.

An additional embodiment includes a sock applier, which is secure and quickly attached to the preferred embodiment. The sock applier comprises a cylindrical cavity having an opening frontal section which is fixed to a pair of inverted "U" shaped members at the lower section. Additionally, a pair of handle bar housings are fixed over the "U" shaped members. A handle bar then substantially extends to provide a comfortable management and it can be utilized on both the handle housing with either a left or right hand.

This and other objects will be apparent to those skilled in the art.

BRIEF DESCRIPTION OF THE DRAWINGS

FIG. 1 illustrates a right elevation view of a preferred embodiment being positioned for installation on a shoe.

FIG. 1A illustrates a partial perspective exploded view of the shoehorn assembly.

DESCRIPTION OF THE INVENTION—FIG. 1-18

Figure 2:
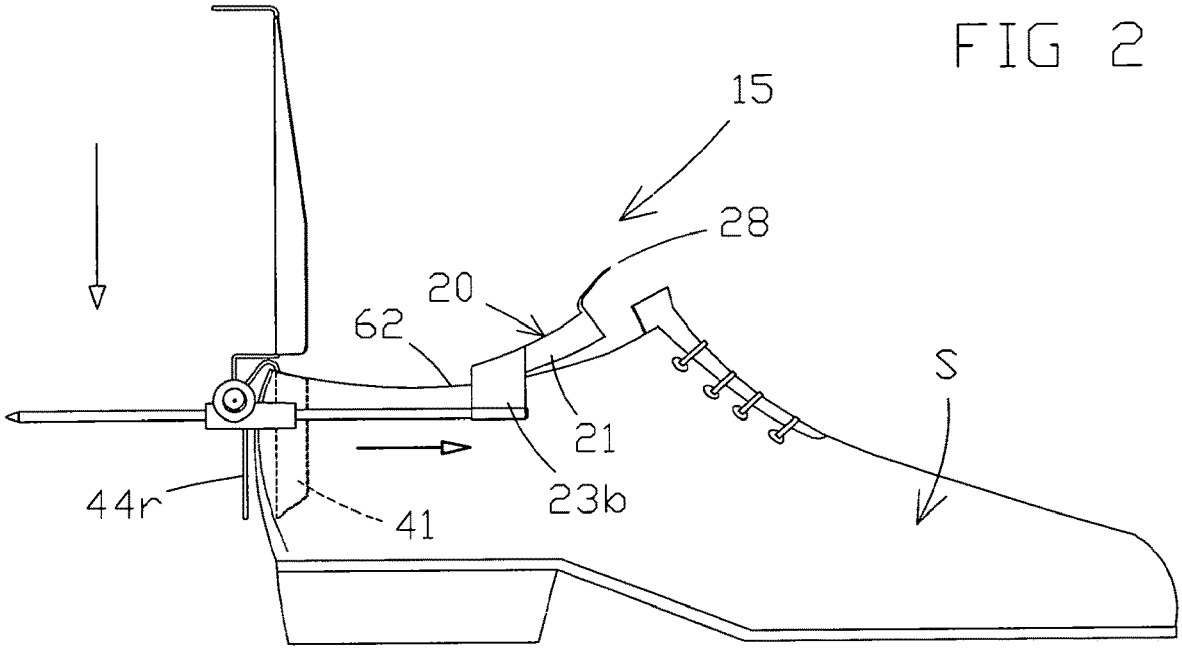
FIG. 2 illustrates a right elevation view of the preferred embodiment partially installed in the shoe.

An improved shoehorn to facilitate a human to wear a foot, comprising:

As illustrates the FIG. 1 the preferred embodiment 15 has the following group of parts:

An arched bridge assembly 20,

A pivotable/locking handle H.

The arched bridge assembly 20 have includes:

21 arched bridge

23*a* left lining groove

23*b* right lining groove

25*a* left connecting rod

25*b* right connecting rod

28 bridge releasing member

The cuff housing assembly 40 have includes:

40*a* cuff groove receiver

41 arched heel section

44*r* flat vertical section

The pivotable locking handle H have includes:

43 locking handle shaft

43*a* left eccentric section

43*b* right eccentric section

44*a* "L" shape handle

45 handle shank

An adjustable shoe size device 15 for use in positioned a person's foot F in a shoe S includes a cuff housing assembly 40 having a pivotable/locking handle H, a cuff/topline, an arched bridge assembly 20 for pushing the front shoe section 61 in a front ward direction and simultaneously pushing the cuff 67 in a rearward direction to maintain facings 62 separated by providing substantial pressure in order to increase the foot access. The device further includes a bridge releasing member 28 to pull up the bridge when a user desires to release it.

The device of this invention is effective for individuals capable of bending over while seating and more importantly may be used by individuals not capable of bending over due to conditions such as low back pain, obesity, etc.

Figure 16:
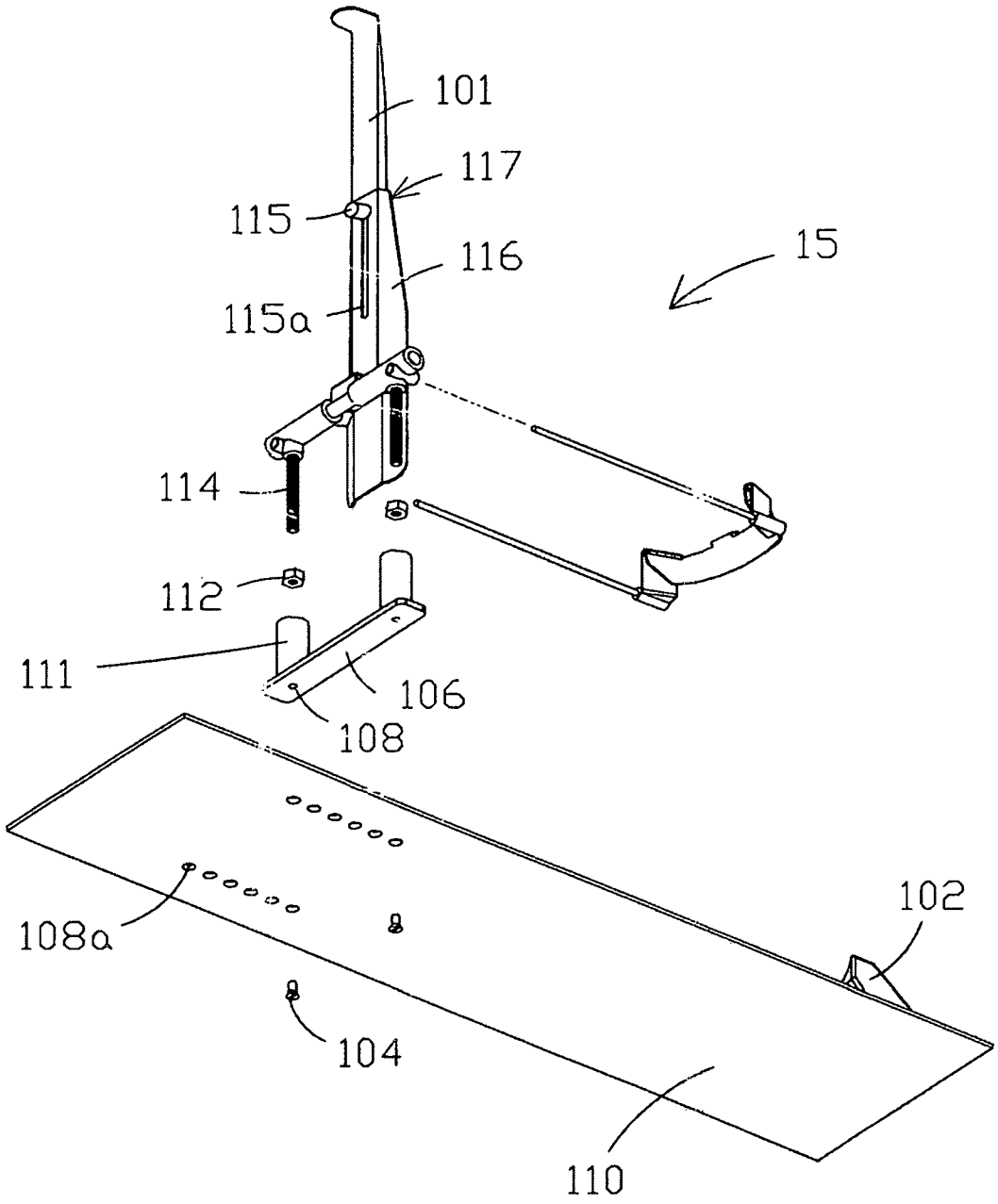
FIG. 16 illustrates a bottom exploded perspective view of an alternative embodiment.

An alternate embodiment 15, as shown in FIG. 16, includes a retractable handle 117 for managing the pivotable/locking handle H, to increase the pressure over the heel while in the cuff lid 68. The handle H pivots in a frontward direction as indicated by the arrow and also includes a flat floor support 110 with a front shoe stop member 102 a the front upper section to accommodate the front shoe section. The alternate embodiment further includes a plurality of threaded holes 108*a* provided as a pair that is centralized by the sear section and aligns with a flanged section 106 which joins a pair of threaded vertically fixed barrels 111. The barrels 111 include a cavity at each end which receive a pair of threaded rods 114 which are threaded by a pair of adjustable leveling nuts to adjust a height. The threaded rods 114 are fixed in the bottom section of the pivotable housings 49*a* and 49*b* and are of a small thread fit size to fit within threaded barrels 111 for the purpose of being quickly inserted or released from barrel cavities 111*a*. Additionally, this provides a firm engagement while the device is in use.

Figure 14:
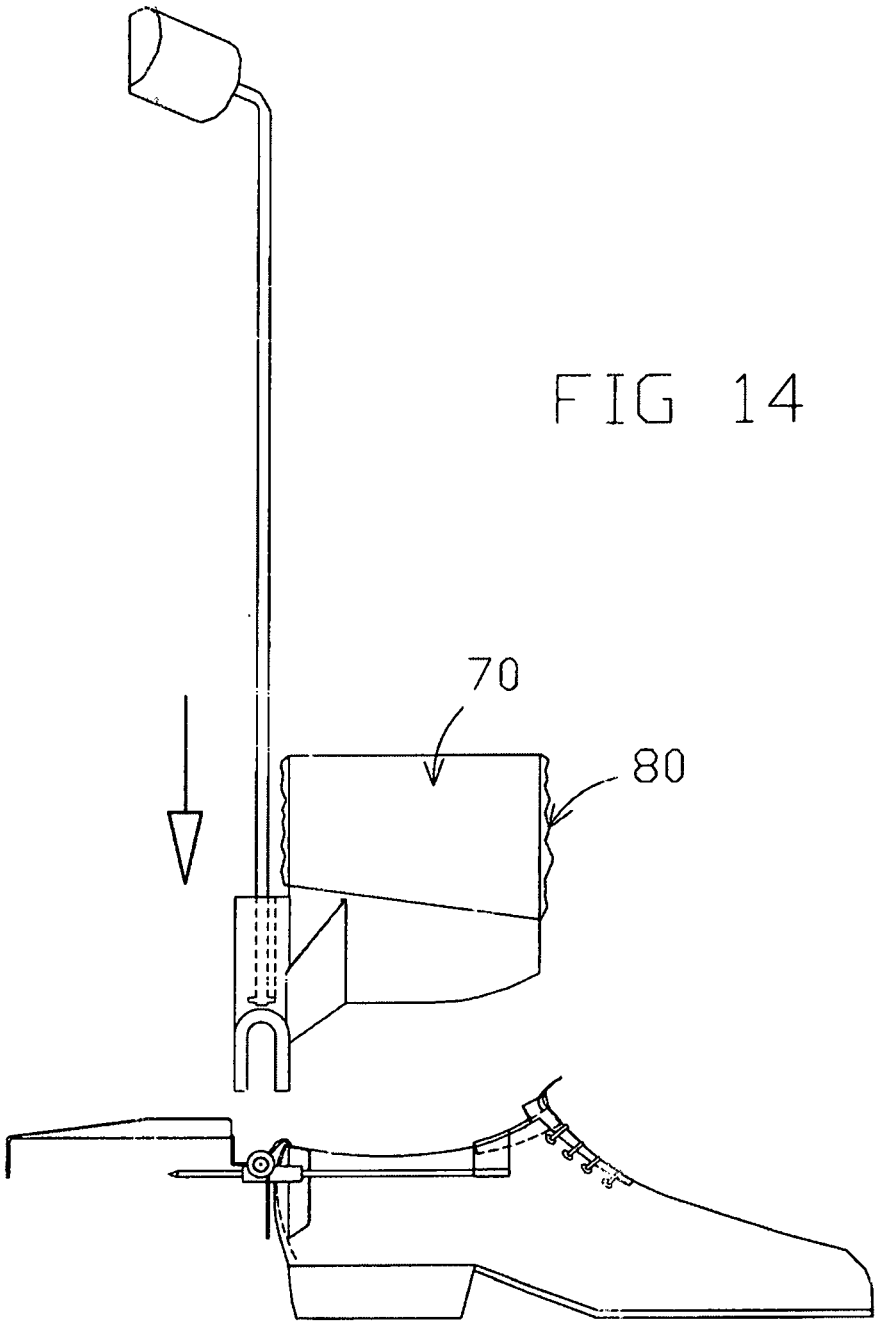
FIG. 14 illustrates a right elevation view of the additional embodiment positioning to be installed in the preferred embodiment.

An additional embodiment includes a sock applier attachment 70, which is secured and quickly attached to the preferred embodiment 15, as shown in FIG. 14. The sock applier attachment 70 includes a cylindrical cavity 73 having a opening frontal section 73*a* surrounding a lid 74. Additionally, a pair of joining members are fixed to a pair of barrels 76 which have a pair of inverted U-shaped members 75 at the lower section. A pair of keyed handle bar housing form part of the cavities 72*b* and 72*c* that are fixed over the barrels 76. Furthermore, a handle bar 72 is designed to fit in the handle bar housings 72*b* and 72*c* which self locks when it is turned and a pin 72*e* reaches a bottom most section 72*d*. The handle bar appears substantially extended to provide a comfortable management so it can be utilized on either handle bar housing 76 to be operated by either a left handed or right handed person.

A sock 80 is applied around the half cylinder on the sock applier attachment 70. The foot 90 goes in the middle of the applied sock opening 73 covering the foot 90 with the opened sock 80. As the foot 90 enters the sock opening 73, the sock 80 is simultaneously applied to the foot 90.

FIGS. 1 and 1A. FIG. 1 illustrates the handle assembly H includes a handle shaft 43 at a bottom section which has an left eccentric section 43*a* and right eccentric section 43*b* and respective ends. The cuff housing assembly 40 includes an arched heel section 41 and a flat vertical section 44*r*. both sections 41 and 44*r* are joined by an "L" shaped projection 44*a*. two shaft handle housings 49*a* and 49*b* are fixed to the cuff assembly by flanges 48*a* and 48*b*. Two rod guides 51*a* and 51*b* are perpendicularly fixed to the lower section of the shaft handle housings 49*a* and 49*b*.

FIG. 2 illustrates the cuff housing assembly 40 fully engaged in the cuff 67. The arched bridge assembly 20 appears resting over the upper surface of the lining 62 in position to be drawn in a frontward direction. The left lining groove 23*a* and the right lining groove 23*b* guide the arched bridge assembly 20 and allows for pivoting in multiple angles (see FIGS. 3A and 4).

Figure 3:
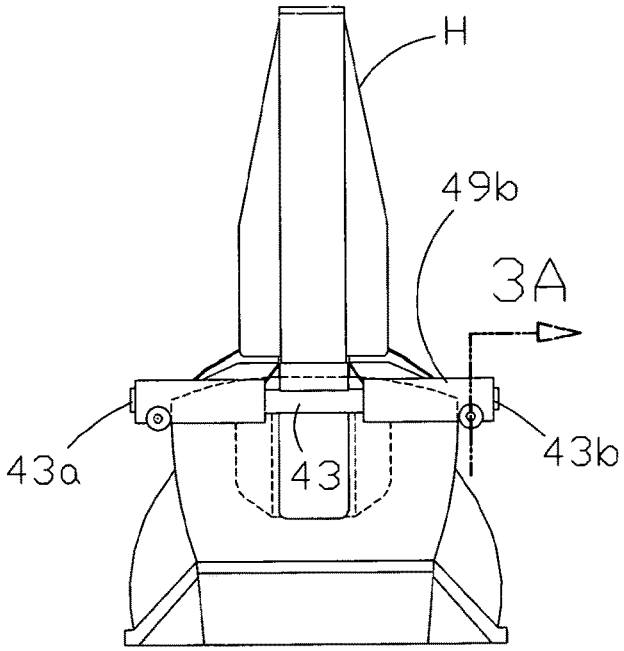
FIG. 3 illustrates a rear elevation view of the preferred embodiment installed in the shoe.
Figure 3A:
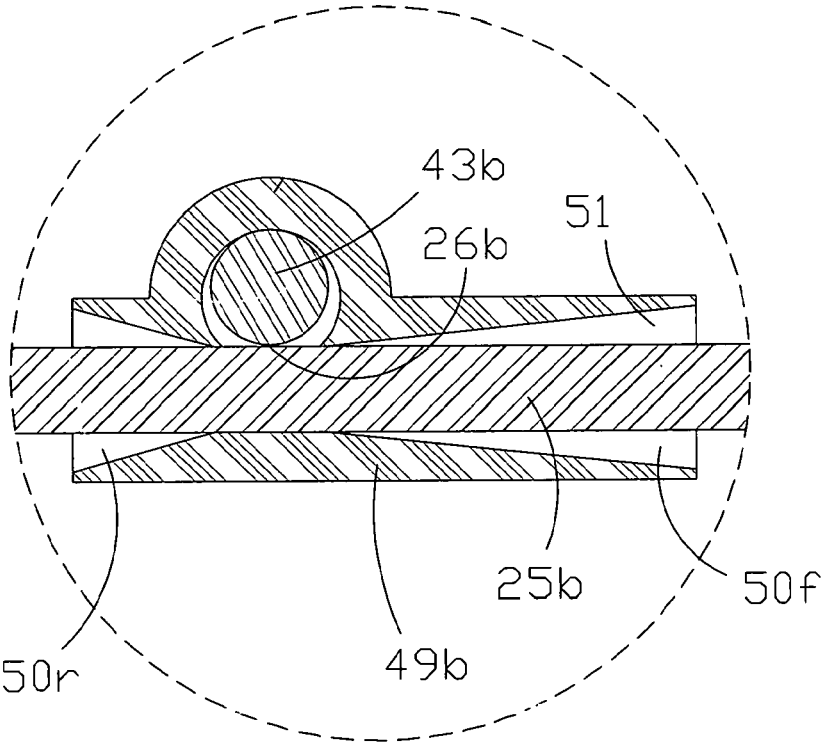
FIG. 3A illustrates an enlarged detail partial cut section view coining from the FIG. 3.
Figure 4:
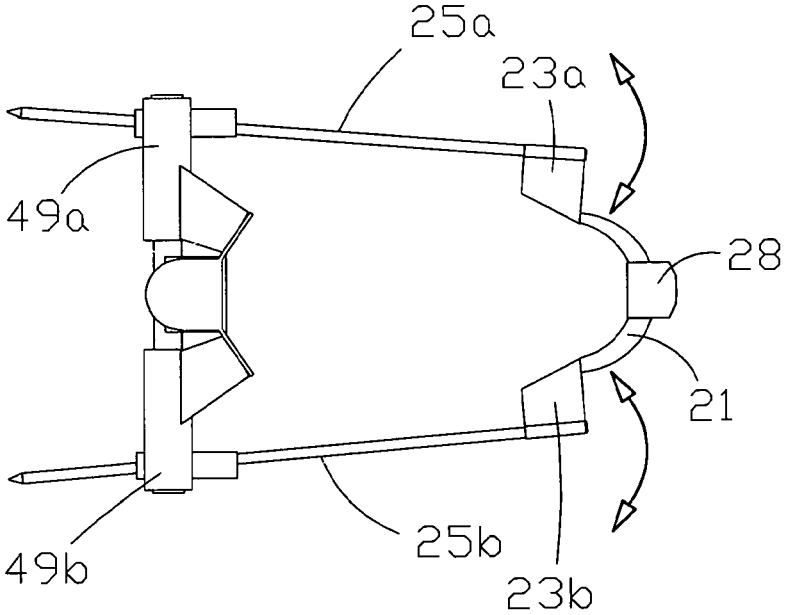
FIG. 4 illustrates a top elevation view showing the alternative angles in which the preferred embodiment can be installed.

FIGS. 3, 3A, and 4. FIG. 3 illustrates the handle assembly H in a vertical position. As observed in FIG. 3A the right eccentric section 43*b* appears lesser separated of the rod bar surface 26*b* thereby allowing the right connecting rod 25*b* to be moved in a frontward or rearward direction. A rear conic section 50*r* and a front conic section 50*f* allows the right connecting rod 25*b* to pivot in multiple angles (FIG. 4). Both rods can perform the same function. A left lining groove 23*a* and a right lining groove 23*b* are included which join the left connecting rod 25*a* and right connecting rod 25*b* to the arched bridge 21.

Figure 5:
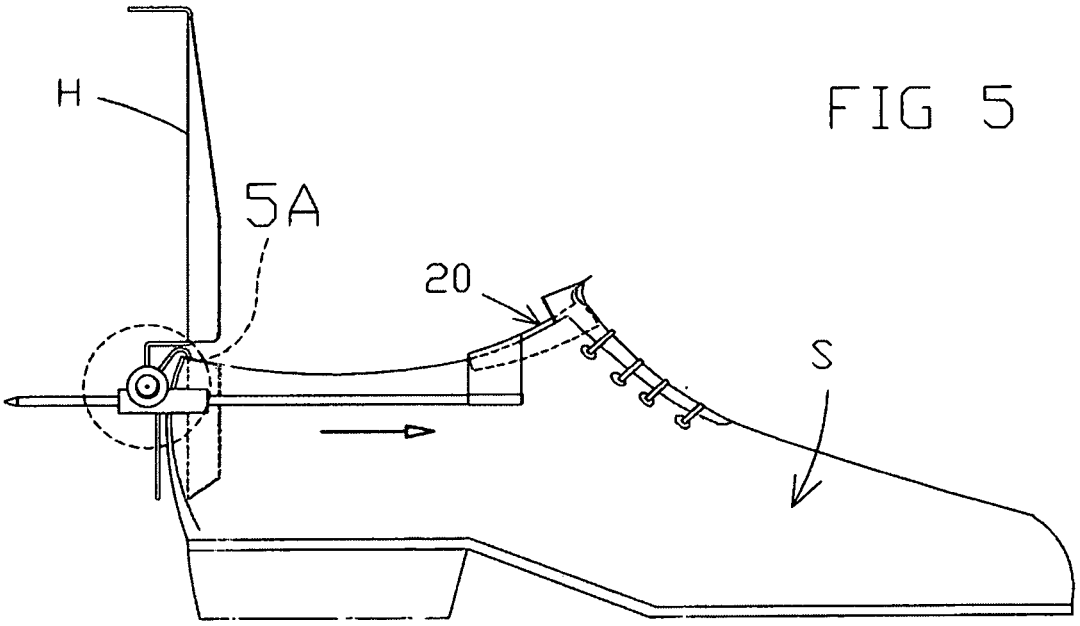
FIG. 5 illustrates a right elevation view of the preferred embodiment fully installed in the shoe.
Figure 5A:
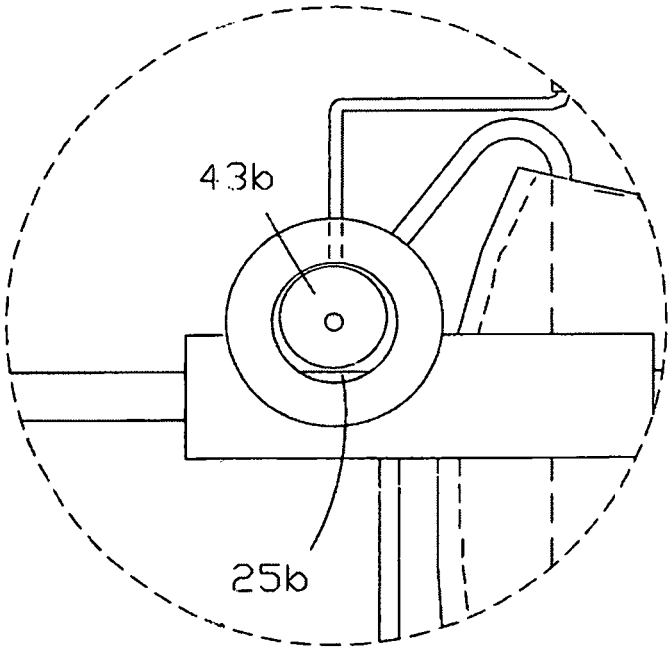
FIG. 5A illustrates an enlarged detail view coining from the FIG. 5.

FIGS. 5 and 5A illustrates the arched bridge assembly 20 fully engaged in the throat 61 while the handle H remains raised and the right eccentric section 43*b* appears separated from the right connecting rod 25*b*.

Figure 6:
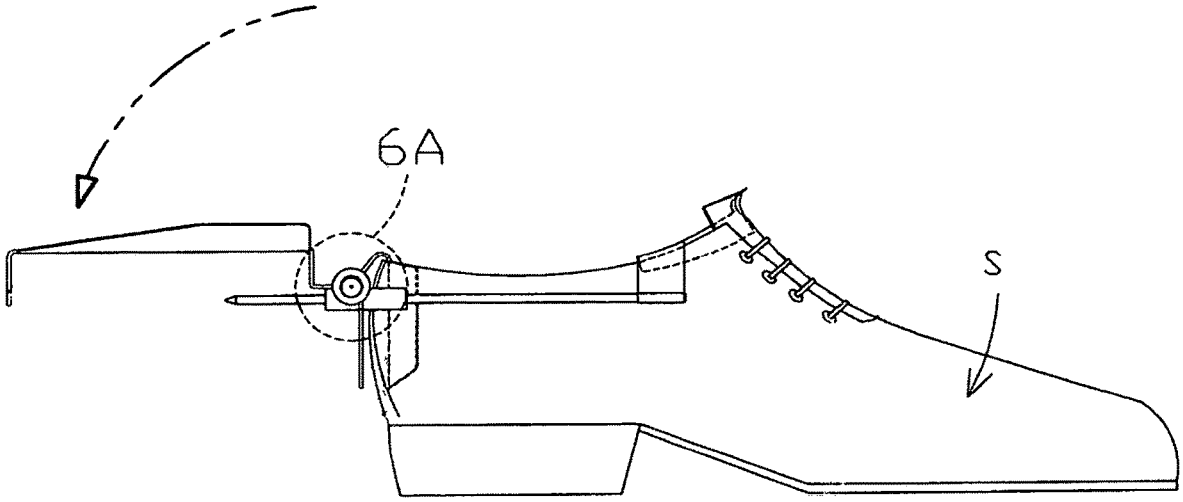
FIG. 6 illustrates a right elevation view of the preferred embodiment with the handle in an alternative position.
Figure 6A:
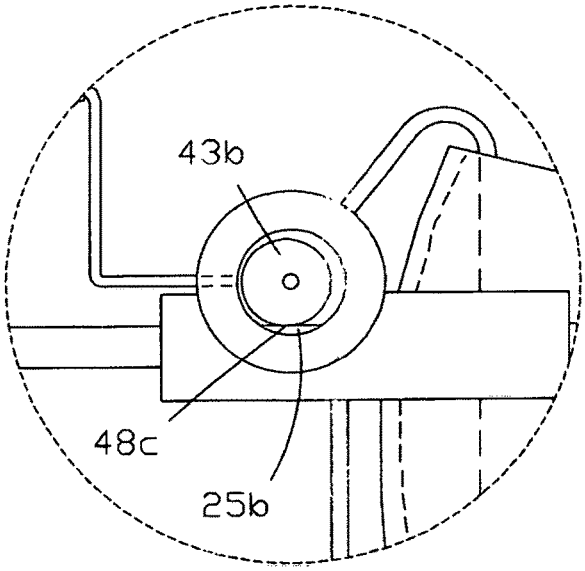
FIG. 6A illustrates an enlarged detail view coining from the FIG. 6.

FIGS. 6 and 6A illustrates the handle H in vertical position, the right eccentric section 43*b* press the right connecting rod 25*b* creating an intersection 48*c* which locks the right connecting rod 25*b*.

Figure 7:
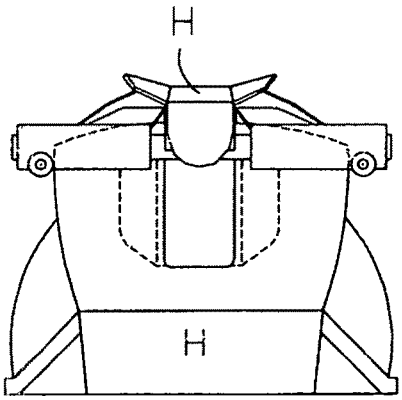
FIG. 7 illustrates a rear elevation view with the handle in an alternative position.

FIG. 7 illustrates how the handle H appears in a locking position.

Figure 8:
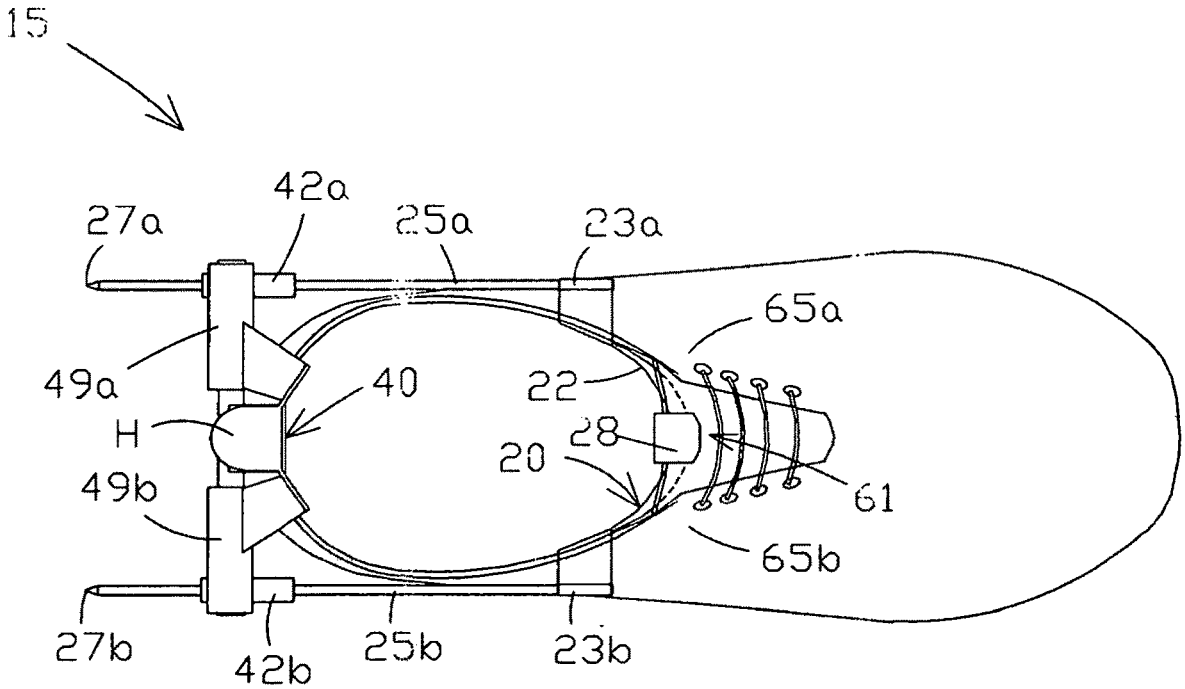
FIG. 8 illustrates a top elevation view of the preferred embodiment fully installed in the shoe.

FIG. 8 illustrates a top view of the device mounted on a shoe.

Figure 9:
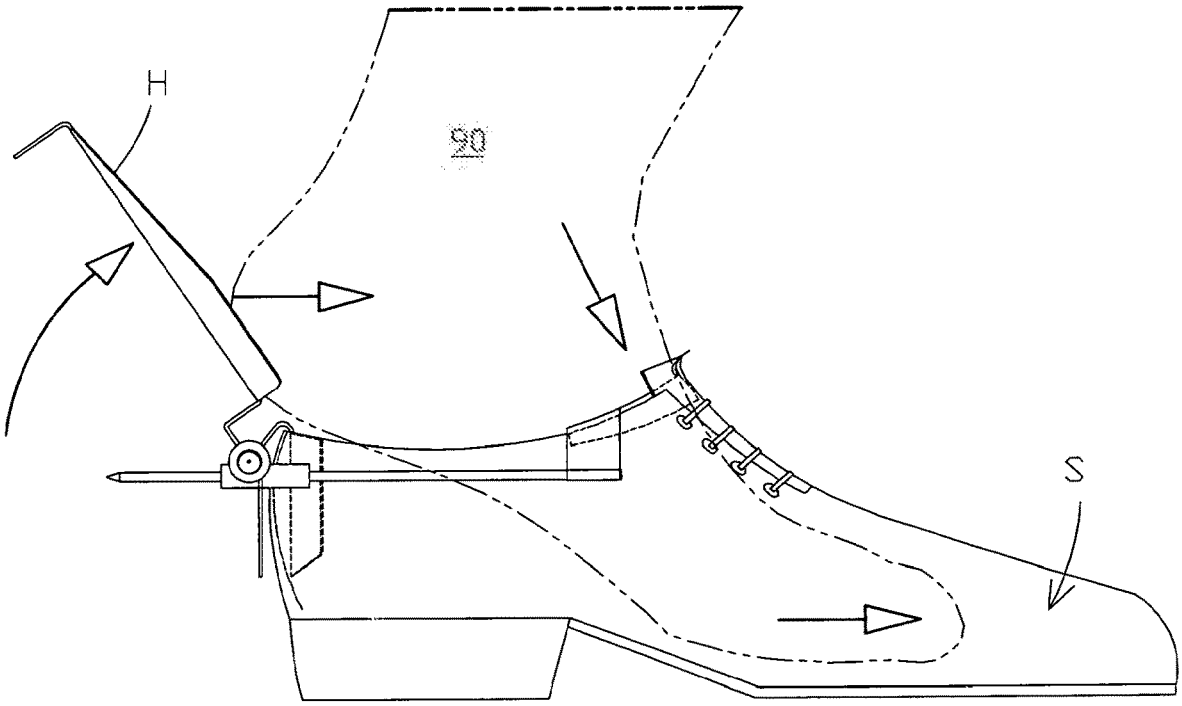
FIG. 9 illustrates a right elevation view of the preferred embodiment in an initial working position.

FIG. 9 illustrates a foot 90 positioned to be inserted in a shoe S as the handle H is pushing the heel in a frontward direction.

Figure 10:
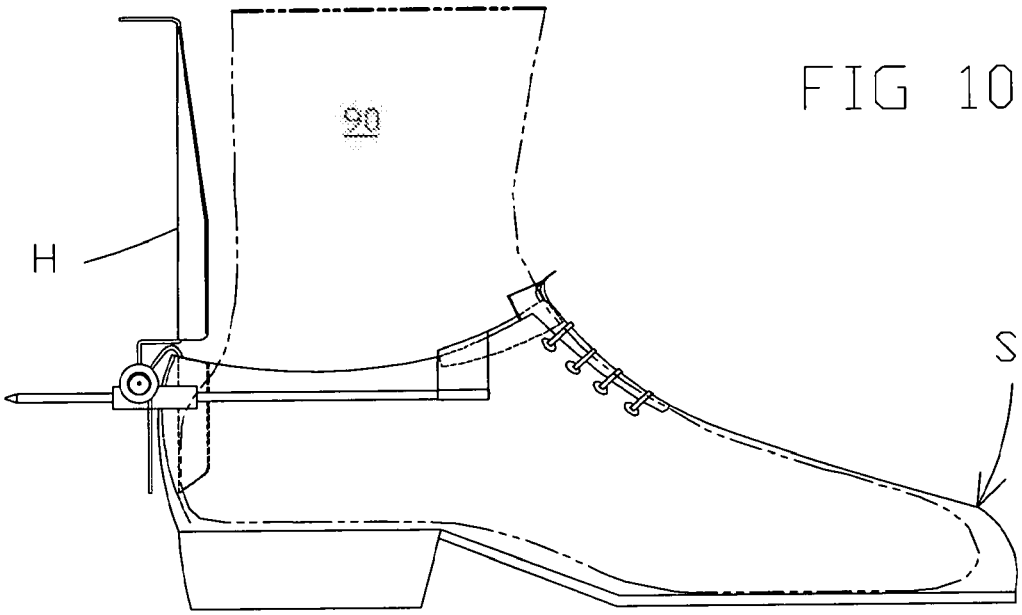
FIG. 10 illustrates a right elevation view of the preferred embodiment in tine final working position.

FIG. 10 illustrates the foot 90 totally inside of the shoe S, the handle helps to fit the foot.

Figure 11:
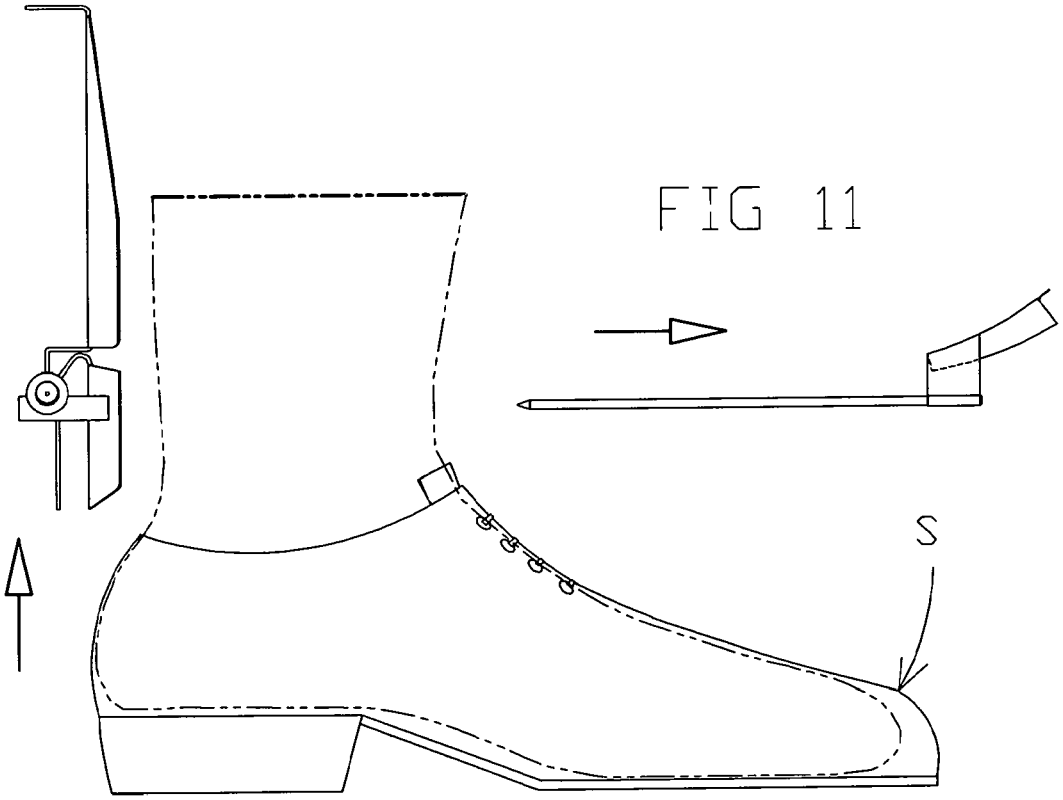
FIG. 11 illustrates a right elevation view releasing the preferred embodiment from the shoe.

FIG. 11 illustrates the separation of the arched bridge assembly 20 and the cuff housing assembly 40.

Figure 12:
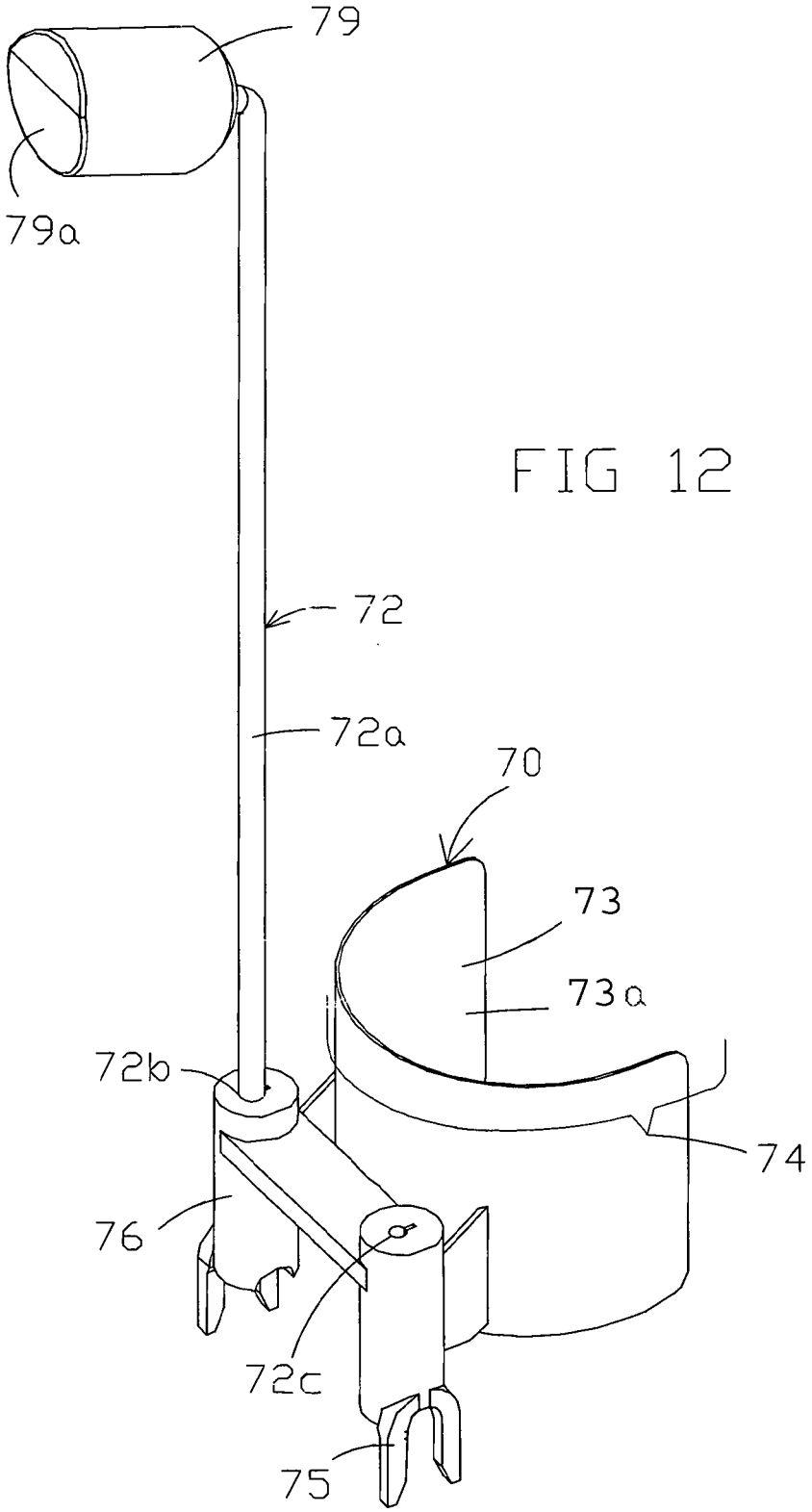
FIG. 12 illustrates a perspective view of an additional embodiment of the present invention.
Figure 13:
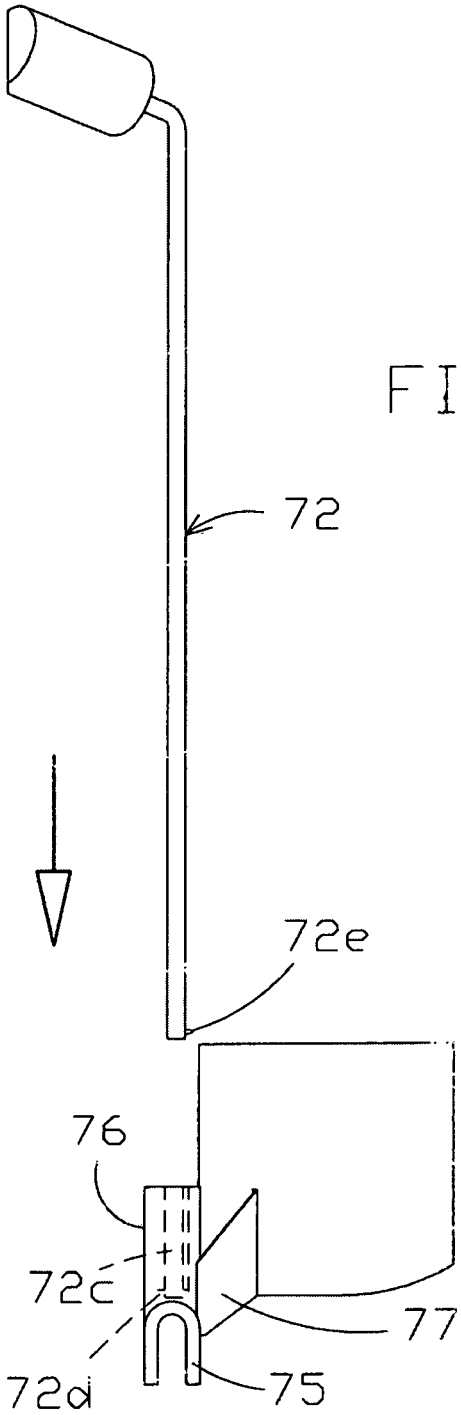
FIG. 13 illustrates a partial right elevation exploded view of the additional embodiment.
Figure 15:
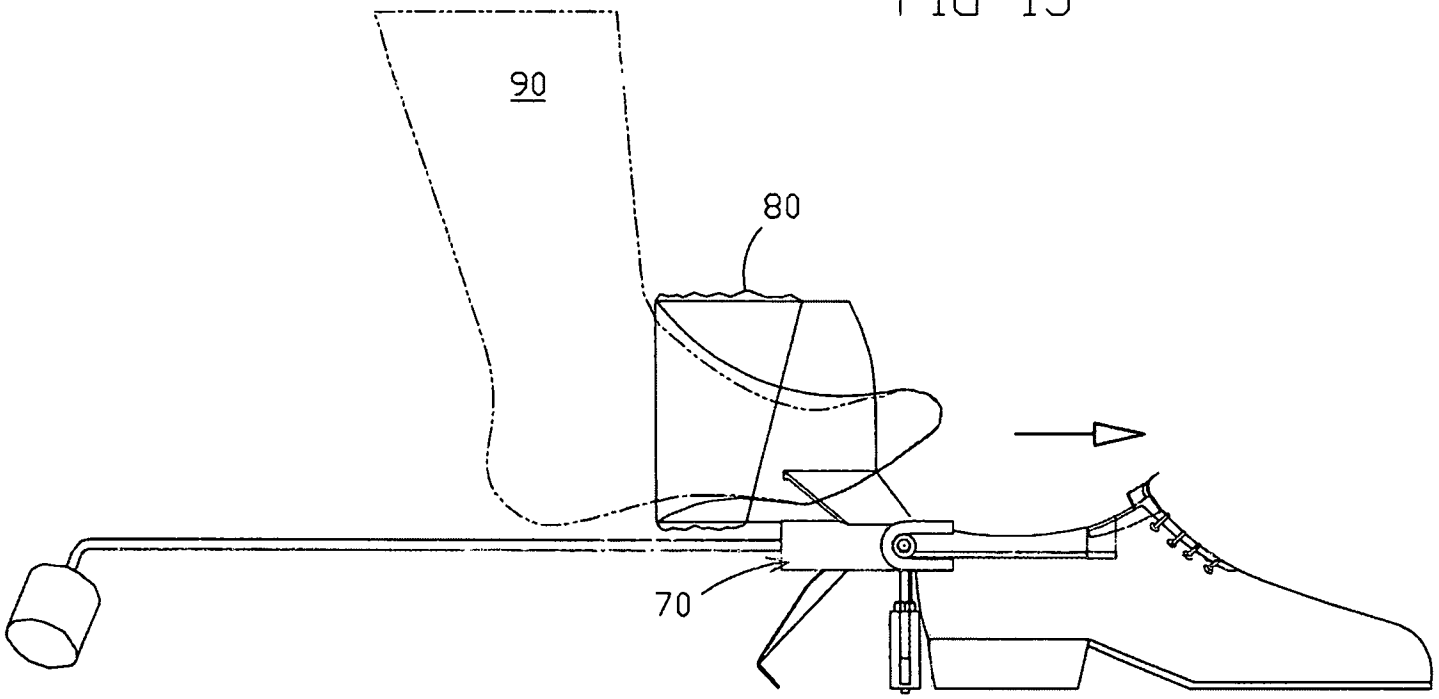
FIG. 15 illustrates a right elevation view of the additional embodiment in the first working position.

The sock applier attachment 70 comprises;

72 removable handle
72*a* rounded bar
72*b* left cavity
72*c* right cavity
73 cylindrical cavity
74 surrounding lid
75 inverted "U" shape
76 barrels
79 rounded handle
79*a* flat section FIGS. 12 and 13 illustrates the sock applier attachment 70 to perform as an attachment to help wear a sock 80 (FIG. 15). The device can be quickly set over the handle shaft housings 49*a* and 49*b*. The device further includes an open cylindrical cavity 73 which serves as a sock housing that is engaged with two parallel barrels 76 by means of two flat members 77. The device further includes a lid 74 designed to hold a sock in a fit position. The device further includes two left and right cavity 72*b* and respectively includes two locking sections 72*d* into barrels 76. Furthermore, two inverted "U" shaped members 75 are included for coupling the preferred embodiment handle shaft housings 59*a* and 49*b* external upper surfaces. The device further includes a removable handle 72 having a rounded bar 72*a* with a locking pin 72*e* at a bottom end, to lock within locking grooves 72*d*. Additionally, a rounded handle 79 having a flat section 79*a* is included designed to accommodate in a flat section or floor for supporting the load of a foot while the user is wearing a sock 80.

FIG. 13 illustrates a partial exploded view of the sock applier attachment 70, showing the position of the handle bar 72, which is interchangeable into the left and right cavities 72*b* and 72*c* respectively.

FIG. 14 illustrates the sock applier attachment 70 positioned to be installed in the preferred embodiments 15, the sock is attached to the surrounding lid 74.

FIG. 15 illustrates the sock applier attachment 70 while the foot 90 is wearing a sock. The handle 79 is resting in a floor surface to help to increase the performance.

Figure 17:
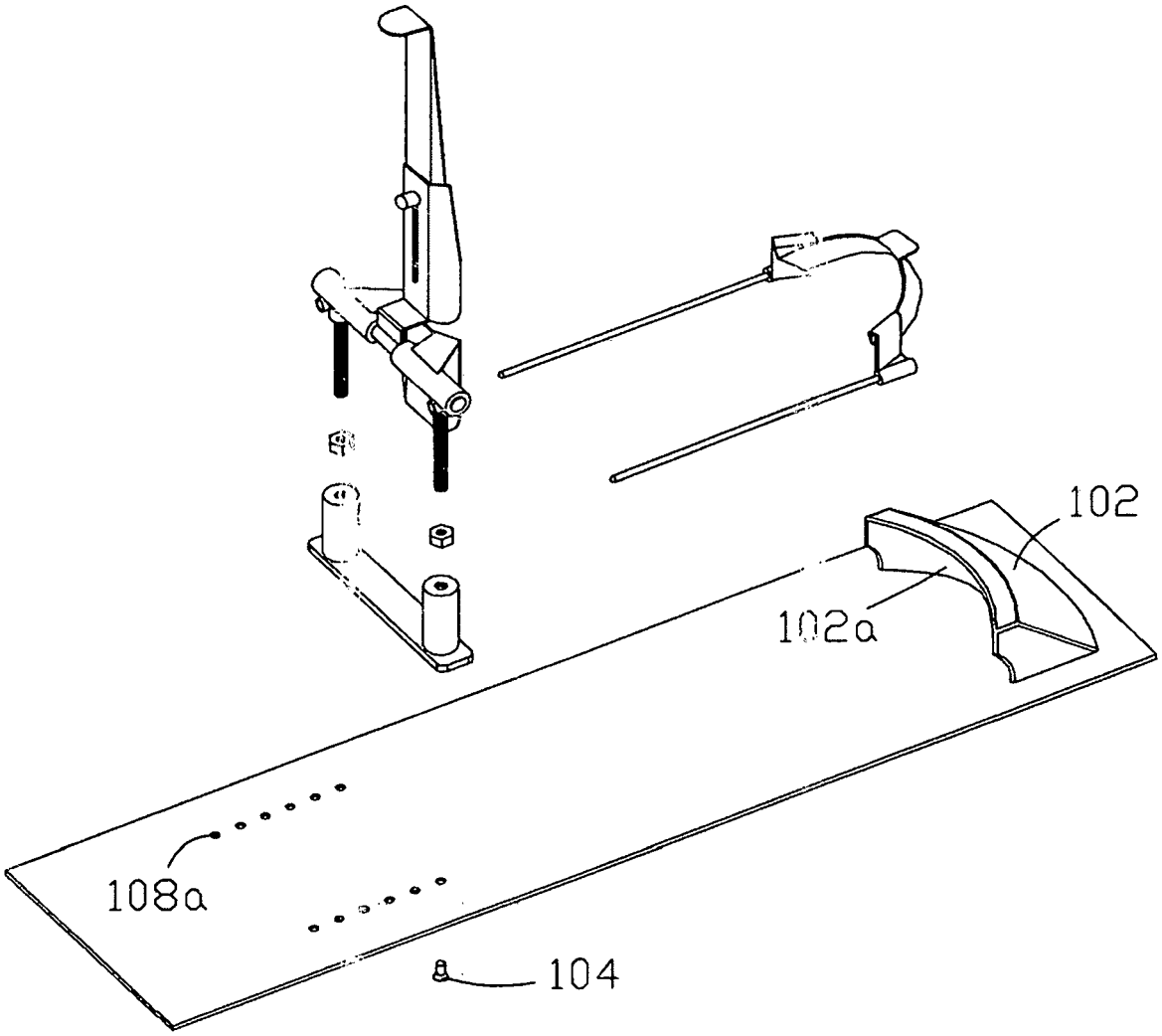
FIG. 17 illustrates a top exploded perspective view of the alternative embodiment.
Figure 18:
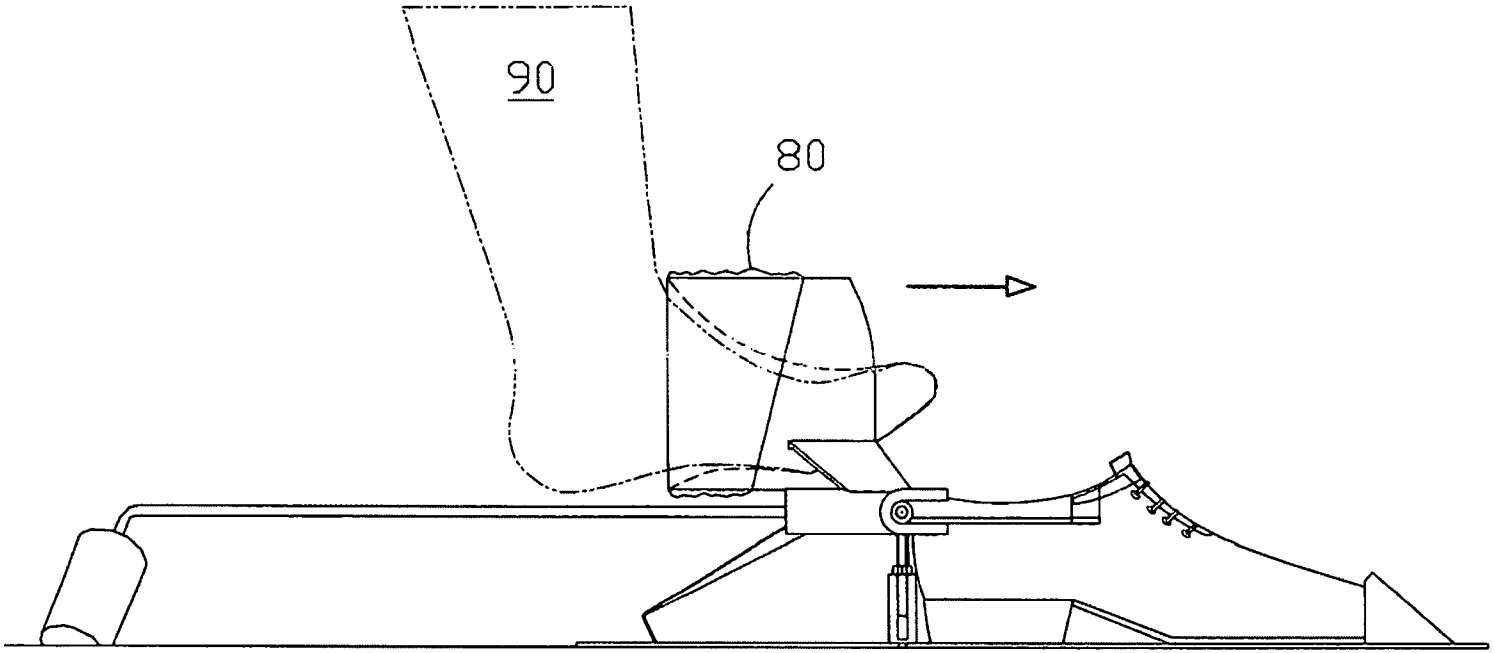
FIG. 18 illustrates the alternative embodiment along with the additional embodiment in an initial working position.

An alternative embodiment 15 includes:

101 retractable handle section
102 front shoe stop member
102*a* front shoe body housing
104 pair of screws
106 flanged section
108 threaded cavities
108*a* pluralities of holes
110 flat floor support
111 threaded barrels
112 nut
114 threaded rods
115 channel
116 heel arch section FIGS. 16 and 17 illustrates an alternative embodiment 15 in which a flat floor support 110 is depicted having two pluralities of holes 108 which aligns with two sets of threaded cavities 108 to select a variety of shoe sized to be secured to the flat floor support 110 by means of a pair of screws 104. A front shoe stop member 102 is fixed to the front upper section of the flat floor support 110 to support the load of a shoe front section into a grove 102*a* while in use of the alternate embodiment 15. Two treaded barrels 111 are joined to a flanged section 106. The threaded barrel sections 111 are designed to adjust the levels of the threaded rods 114. Additionally, a nut 112 is implemented to set a desired level. The alternate embodiment further includes and adjustable length handle 101 which slides into a channel 115*a* built into a heel arch section 116. A knob 115 is utilized to adjust the length.

What is claimed is:

1. An improved shoehorn to facilitate a human to wear a shoe, comprising:

a) a cuff housing assembly including a cuff groove receiver, said cuff housing assembly further including an arched heel section and a flat vertical section, wherein said cuff housing assembly further includes a flat floor support with a plurality of shoe size selecting holes;

b) an adjustable arched shaped bridge having a curvature; and c) a pivotable handle/locking assembly including a handle shaft with a left eccentric section and a right eccentric section, wherein the left eccentric section and right eccentric section are oppositely located with respect to the handle shaft.

2. The improved shoehorn to facilitate a human to wear a shoe of claim 1 wherein said cuff housing assembly includes a pair of vertical barrels connected to threaded rods.

3. The improved shoehorn to facilitate a human to wear a shoe of claim 2 wherein said cuff housing assembly includes a pair of nuts engaged with said threaded rods.

4. The improved shoehorn to facilitate a human to wear a shoe of claim 1 further including a front shoe stop member on the flat floor support.

5. The improved shoehorn to facilitate a human to wear a shoe of claim 1 further including a sock applier engaged to said handle shaft.

6. The improved shoehorn to facilitate a human to wear a shoe of claim 5 further including two inverted "U" shaped members engaged at a bottom section of a pair of vertical barrels.

7. An improved shoehorn to facilitate a human to wear a shoe, consisting of:

a) a cuff housing assembly including a cuff groove receiver, said cuff housing assembly further including an arched heel section and a flat vertical section, wherein said cuff housing assembly includes a pair of vertical barrels connected to threaded rods, wherein said cuff housing assembly further includes a flat floor support with a plurality of shoe size selecting holes;

b) an adjustable arched shaped bridge having a curvature;

c) a pivotable handle/locking assembly including a locking handle shaft with a left eccentric section and a right eccentric section; and d) a sock applier coupled to the cuff housing assembly.

* * * * *